United States Patent [19]

Kasashima et al.

[11] 4,295,119

[45] Oct. 13, 1981

[54] ROTARY VARIABLE RESISTOR

[75] Inventors: Masao Kasashima; Yoshizo Kubo, both of Miyagi, Japan

[73] Assignee: Alps Electric Co., Ltd., Tokyo, Japan

[21] Appl. No.: 128,941

[22] Filed: Mar. 10, 1980

[30] Foreign Application Priority Data

Mar. 12, 1979 [JP] Japan ..... 54-31478[U]

[51] Int. Cl.[3] ..... H01C 10/32

[52] U.S. Cl. ..... 338/162; 338/164; 338/184; 338/199

[58] Field of Search ..... 338/162, 163, 164, 174, 338/160, 184, 199; 29/610

[56] References Cited

U.S. PATENT DOCUMENTS 3,387,247 6/1968 Mishler ..... 338/162
3,389,364 6/1968 Budd et al. ..... 338/174
3,456,227 7/1969 Paine et al. ..... 338/164
3,531,753 9/1970 Geese ..... 338/174 X
3,601,743 8/1971 Mathison et al. ..... 338/174 X

*Primary Examiner*—C. L. Albritton
*Attorney, Agent, or Firm*—Guy W. Shoup; Gerard F. Dunne

[57] ABSTRACT

A rotary variable resistor comprises a wiper mounted in a recess in a substantially cylindrical, hollow wiper holder formed integrally with a control shaft, and an elastic flange integrally formed with the lower peripheral end portion of the wiper holder. This variable resistor is characterized in that the wiper holder is rotatably supported between an insulating substrate and a cover such that wiper legs projected from the lower end surface of the flange can be slid resiliently on the insulating substrate.

3 Claims, 5 Drawing Figures

ROTARY VARIABLE RESISTOR

BACKGROUND OF THE INVENTION

1. Field of the Invention

The present invention relates to a rotary variable resistor and, more particularly, to a rotary variable resistor having an improved wiper holder.

2. Description of the Prior Art

A rotary variable resistor of this kind is provided with a cover, a substrate carrying a resistance element, and a rotor which has a wiper attached thereto and which is rotatably supported between the cover and substrate, and disclosed in, for example, U.S. Pat. No. 3,387,247.

However, in a variable resistor as disclosed in the above patent, it is necessary that an O-ring be interposed between the rotor and the housing to allow the rotor to have a suitable driving torque.

SUMMARY OF THE INVENTION

It is an object of the present invention to provide a rotary variable resistor in which a suitable torque can be readily obtained.

Another object of the present invention is to provide a rotary variable resistor having a rotor provided with means integrally formed therewith to obtain a driving torque.

Still another object of the present invention is to provide a rotary variable resistor having a rotor which can be rotated smoothly and stably.

A further object of the present invention is to provide a rotary variable resistor which has a smaller number of parts and which can be manufactured at a low cost.

To these ends, the present invention provides a rotary variable resistor comprising a cover having an opening, a substrate secured to the opening of the cover and carrying a resistance element and terminals, and a rotor of a synthetic resin which is rotatably supported between the cover and the substrate. The rotor is provided with a recess for holding an upwardly extended shaft, and a wiper is held to the lower surface of the rotor. An elastic flange is formed on the peripheral portion of the lower end of the rotor, and legs project downwardly from the flange and are slidable on the substrate. In this way, the rotor is elastically held between the cover and substrate owing to the elasticity of the flange.

The above and other objects as well as the advantageous features of the invention will become clear from the following description of a preferred embodiment taken in conjunction with the accompanying drawings.

DESCRIPTION OF PREFERRED EMBODIMENT

An embodiment of the present invention will be described in detail with reference to FIGS. 1-5.

Figure 1:
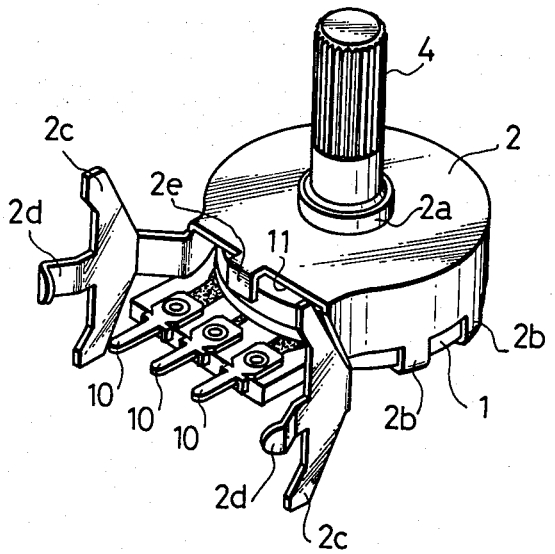
FIG. 1 is a perspective view of a rotary variable resistor embodying the present invention.

Referring to FIG. 1, which is a perspective view of a rotary variable resistor embodying the present invention, reference numeral 1 denotes an insulating substrate having a resistor and a current collector formed on the upper surface thereof by suitable means such as printing, reference numeral 2 denotes a substantially cylindrical metal cover fixed to the insulating substrate 1 by mounting legs **2*b*, and reference numeral 2*a* denotes projection provided on the cover 2 so as to support a control shaft 4** which will be described later.

Figure 2:
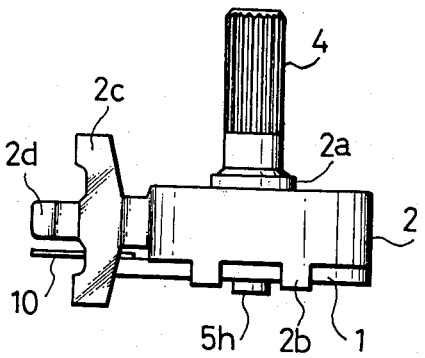
FIG. 2 is a side elevational view of the embodiment shown in FIG. 1.

Reference numeral **5*h* denotes a shaft of a wiper holder 5 which will be described later, the shaft 5*h* being passed through and projected from the insulating substrate 1 as clearly shown in FIG. 2**.

Reference numeral 10 denotes terminals fixed to the insulating substrate 1 by suitable means such as caulking, and connected to the resistor and current collector mentioned above.

Reference numerals **2*c*, 2*c* denote wings integrally formed with the cover 2, and reference numeral 2*d* mounting legs which are also integrally formed with the cover 2 and which are bent such that the mounting legs 2*d*** have a predetermined elastic force whereby they can be snapfitted into another part.

The cover 2 has an opening 11 between the two mounting legs **2*d* and two wings 2*c*, 2*c*, the opening 11 serving as a window from which the terminals 10** protrude.

Figure 3:
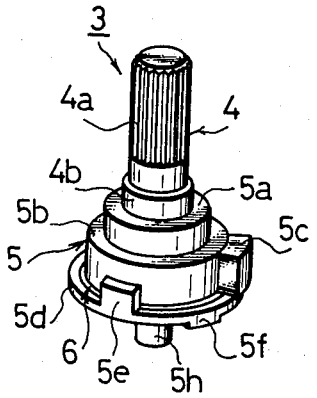
FIG. 3 is a perspective view of a rotor in the embodiment shown in FIG. 1.

FIG. 3 shows a rotor 3 integrally made of an insulating synthetic resin and provided with a control shaft 4 adopted project outwardly from the cover 2, and a substantially cylindrical wiper holder 5.

Reference numeral **4*a* denotes a serrated portion of the control shaft 4; reference numeral 4*b* denotes a larger diameter portion of the control shaft 4, rotatably supported by the above-mentioned projection 2*a*; reference numeral 5*a* denotes an annular shoulder portion of the wiper holder 5, engageable with the lower surface of an upper portion of the cover 2 (refer to FIG. 5); reference numeral 5*b* denotes a main portion of the wiper holder 5; and reference numeral 5*c* denotes a projection serving as a stopper provided on the side surface of the main portion 5*b* and cooperating with a projection 2*e* (refer to FIG. 5), which is provided at that portion of the cover 2 which defines the above-mentioned opening 11, so as to restrict the amount of rotation of the rotor 3**.

Reference numeral **5*d* denotes a thin, circular flange provided at the lower end of the circumferential surface of the main portion 5*b* of the wiper holder 5 and integrally formed with the main portion 5*b* via a plurality of retainer portions 5*e*, and reference numeral 6 denotes arcuate grooves provided in the flange 5*d* so as to furnish the flange 5*d* with a suitable elasticity. When the lower surface of the flange 5*d* is pressed, the flange 5*d* is deformed by its own elasticity. Reference numerals 5*f* . . . denote wiper legs formed integrally with a lower portion of the flange 5*d* and adapted to elastically contact the insulating substrate 1 (refer to FIG. 5**).

Figure 4:
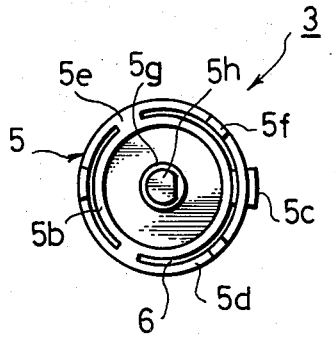
FIG. 4 is a bottom plan view of the rotor shown in FIG. 3.

Referring to FIG. 4, which is a bottom plan view of the rotor 3, reference numeral **5*g* denotes a larger diameter hub portion provided in the central part of a recess in the wiper holder 5; reference numeral 5*h* denotes the above-mentioned shaft of the wiper holder 5, passed through the insulating substrate 1. A wiper 7 consists of an elastic metal plate fastened to the periphery of the hub portion 5***g* by suitable means such as fusing or caulking, and is adapted to resiliently slide on the resistor and current collector.

Figure 5:
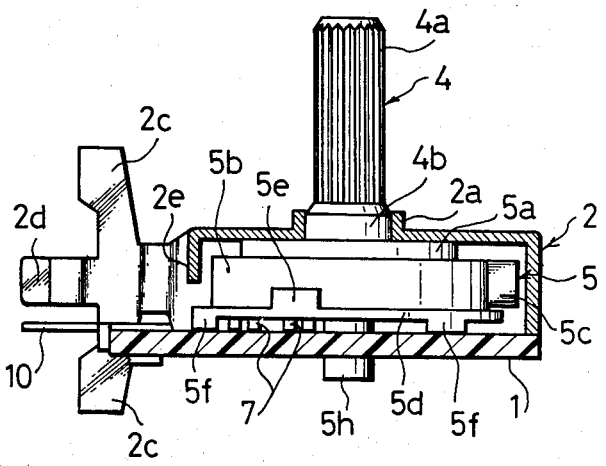
FIG. 5 is a side elevational view partially in cross section of the embodiment shown in FIG. 1.

FIG. 5 is a side elevational view partially in cross section of an embodiment of the present invention in an assembled state in which a rotor 3 with a wiper 7 attached thereto is housed in a cover 2.

As is clear from FIG. 5, a plurality of wiper legs 5*f*. . . provided at the lower end of the flange 5*d* resiliently contact the upper surface of the insulating substrate 1, to thereby serve as a guide for a wiper holder 5 (rotor 3) during rotational movement of the wiper holder 5. At the same time, the flange 5*d* contacts the insulating substrate 1 as the former is deformed in the upward direction. As a result, a shoulder portion 5*a* of the wiper holder 5 is pressed against the lower surface of an upper portion of the cover 2 so that the wiper holder 5 is supported between the cover 2 and insulating substrate 1 such that a suitable elastic force is constantly applied to the wiper holder 5.

The variable resistor shown in the accompanying drawings is an embodiment of the present invention, and an improved wiper holder employed therein may, of course, be applied to various kinds of rotary variable resistors. If a wiper 7 and a resistor corresponding thereto are arranged within a wiper holder 5, a gap between the flange portion 5*d* and the upper surface of a substrate becomes extremely small. In such a case, the variable resistor has a sufficient dustproofing effect even if mounting legs 2*d* are provided in the above-described manner to necessarily form an opening in a cover 2.

The present invention is not, of course, limited to the above-described embodiment but may be modified in various ways within the scope of the appended claims.

What is claimed is:

1. A rotary variable resistor having a substrate carrying a resistance element connected to terminal portions; a cover member fitting over said substrate and having an upper wall extending generally parallel thereto; and a rotor formed of a synthetic resin and carrying a conductive wiper adapted to slide across said resistance element during rotation of said rotor; said rotor having an upper shoulder adapted to bear against the inner surface of the upper wall of said cover, an elastic flange extending outwardly from the lower portion of said rotor and means including a plurality of legs extending downwardly from said flange and riding on said substrate for elastically deforming said flange upwardly to urge said upper shoulder into continous engagement with the inner surface of the upper wall of said cover.

2. A rotary variable resistor according to claim 1, said flange including a plurality of arc-shaped grooves to increase its elasticity.

3. A rotary variable resistor according to claim 1, said rotor further including a projection integrally formed therewith and engageable with a tongue formed on said cover to provide a stopper limiting rotation of said rotor.

* * * * *